US009383167B1

(12) United States Patent
Connolly et al.

(10) Patent No.: US 9,383,167 B1
(45) Date of Patent: Jul. 5, 2016

(54) POWERED SIGHT MOUNT

(71) Applicant: RAYTHEON CANADA LIMITED, Ottawa (CA)

(72) Inventors: John Maxwell Connolly, Penetanguishene (CA); Kevin Burgess Wagner, Wyevale (CA)

(73) Assignee: RAYTHEON CANADA LIMITED (CA)

( * ) Notice: Subject to any disclaimer, the term of this patent is extended or adjusted under 35 U.S.C. 154(b) by 0 days.

(21) Appl. No.: 14/614,943

(22) Filed: Feb. 5, 2015

(51) Int. Cl.
*F41G 1/387* (2006.01)
*F41G 1/32* (2006.01)
*F41G 11/00* (2006.01)

(52) U.S. Cl.
CPC ..... *F41G 1/387* (2013.01)

(58) Field of Classification Search
CPC ..... F41G 1/32; F41G 1/383; F41G 1/387; F41G 1/38; F41G 1/36; F41G 1/35; F41G 1/34; F41G 1/345; F41G 11/00; F41G 11/001; F41G 11/003; F41G 11/004
See application file for complete search history.

(56) References Cited

U.S. PATENT DOCUMENTS 5,898,519 A * 4/1999 Palmer ..... G02B 23/12 250/214 VT
7,866,083 B2 * 1/2011 Teetzel ..... F41G 1/35 342/45
8,146,282 B2 4/2012 Cabahug
8,220,946 B1 * 7/2012 Teetzel ..... F41C 27/00 362/110
8,371,729 B2 * 2/2013 Sharrah ..... F21S 9/02 362/439
8,448,368 B2 * 5/2013 Cabahug ..... F41G 11/003 42/71.01
8,776,422 B2 7/2014 Dodd
2008/0134562 A1 * 6/2008 Teetzel ..... F41G 11/003 42/146
2008/0246435 A1 * 10/2008 Greenslade ..... F41G 1/32 320/110
2011/0000120 A1 1/2011 Thompson
2011/0131858 A1 * 6/2011 Darian ..... F41C 27/00 42/90
2011/0162251 A1 * 7/2011 Houde-Walter ..... F41G 1/35 42/146
2012/0030985 A1 * 2/2012 Mauricio ..... F41G 1/38 42/84
2012/0053878 A1 3/2012 Windauer et al.
2012/0064387 A1 * 3/2012 Kim ..... H01M 2/021 429/158

(Continued)

FOREIGN PATENT DOCUMENTS

EP 1772695 A1 4/2007
WO 0079625 A1 12/2000

OTHER PUBLICATIONS

International Search Report and Written Opinion; International Application No. PCT/US2015/063724; International Filing Date: Dec. 3, 2015; Date of Mailing: Feb. 19, 2016.

*Primary Examiner* — Bret Hayes
*Assistant Examiner* — Derrick Morgan
(74) *Attorney, Agent, or Firm* — Cantor Colburn LLP

(57) ABSTRACT

A sight mount for use with an electrically powered sight is provided. The sight mount includes a lower portion connectably securable to a mounting surface, an upper portion supportive of the sight and comprising electrodes connectable with sight circuitry and a central portion integrally interposed between the lower and upper portions. The central portion includes a body formed to define a cavity securably receptive of a power supply such that the power supply couples with the electrodes to power the sight.

14 Claims, 5 Drawing Sheets

(56) References Cited

U.S. PATENT DOCUMENTS

2013/0061504 A1* 3/2013 Malherbe ..... F41G 11/003 42/84
2013/0104438 A1 5/2013 Hines
2013/0104439 A1* 5/2013 Hines ..... F41C 27/00 42/84
2013/0152445 A1* 6/2013 Compton ..... F41G 11/003 42/84
2013/0194769 A1* 8/2013 Belack ..... F41G 11/003 361/807
2014/0059911 A1 3/2014 Oh
2014/0130392 A1* 5/2014 Oh ..... F41G 11/003 42/84
2015/0128472 A1* 5/2015 Theisinger ..... F41G 1/38 42/122
2015/0292837 A1* 10/2015 Cheng ..... F41G 1/345 42/123
2015/0308787 A1* 10/2015 Cheng ..... F41G 1/34 42/126

* cited by examiner

POWERED SIGHT MOUNT

BACKGROUND

The present invention relates to a sight mount and, more particularly, to a powered sight mount that can provide power to an electronically powered sight.

A sight is a device used to assist in aligning or aiming weapons, surveying instruments or other items by eyesight. Sights can be a simple set or system of markers that have to be aligned together as well as aligned with the target (referred to as iron sights on firearms). They can also be optical devices that allow the user to see the image of an aligned aiming point in the same focus as the target. These include telescopic sights and reflector (or "reflex") sights. There are also sights that project an aiming point onto the target itself, such as laser sights.

At its simplest, a sight is typically composed of front and rear aiming pieces that have to be lined up. Increasingly advanced sights employ multiple lenses that magnify a target and include cross hairs that allow the target to be aimed at. Still further advances have come in the form of electrically powered sight components, such as optical enhancements to sights whereby the target can be illuminated or painted with a laser. Such electrically powered components require a power source, however, which often needs to be stored in the sight itself. This in-sight power supply storage occupies space within the sight that requires user access to the sight body for recharging or power replacement posing a sealing and contamination risk that could otherwise be avoided. The storage space also increases the overall size of the sight which can increase the scene obstruction for the user. In either case, the amount of power that can be stored in-sight is limited.

SUMMARY

According to one embodiment of the present invention, a sight mount for use with an electrically powered sight is provided. The sight mount includes a lower portion connectably securable to a mounting surface, an upper portion supportive of the sight and comprising electrodes connectable with sight circuitry and a central portion integrally interposed between the lower and upper portions. The central portion includes a body formed to define a cavity securably receptive of a power supply such that the power supply couples with the electrodes to power the sight.

According to another embodiment, a sight mount for use with an electrically powered sight and an elongate mounting surface of a shoulder mounted weapon is provided. The sight mount includes a lower portion connectably securable to the mounting surface, an upper portion supportive of the sight and comprising electrodes connectable with sight circuitry and a central portion integrally interposed between the lower and upper portions. The central portion includes a body formed to define a cavity securably receptive of batteries such that the batteries couple with the electrodes to power the sight.

According to yet another embodiment, a sight mount for use with an electrically powered sight and an elongate mounting surface of a shoulder mounted weapon is provided. The sight mount includes first and second lower portions connectably securable to first and second axial locations of the mounting surface, respectively, first and second ring-shaped upper portions supportive of the sight at first and second axial locations defined along the sight and comprising electrodes connectable with sight circuitry and a central portion integrally interposed between each of the first and second lower and upper portions. The central portion includes a body formed to define a cavity securably receptive of batteries such that the batteries couple with the electrodes to power the sight.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
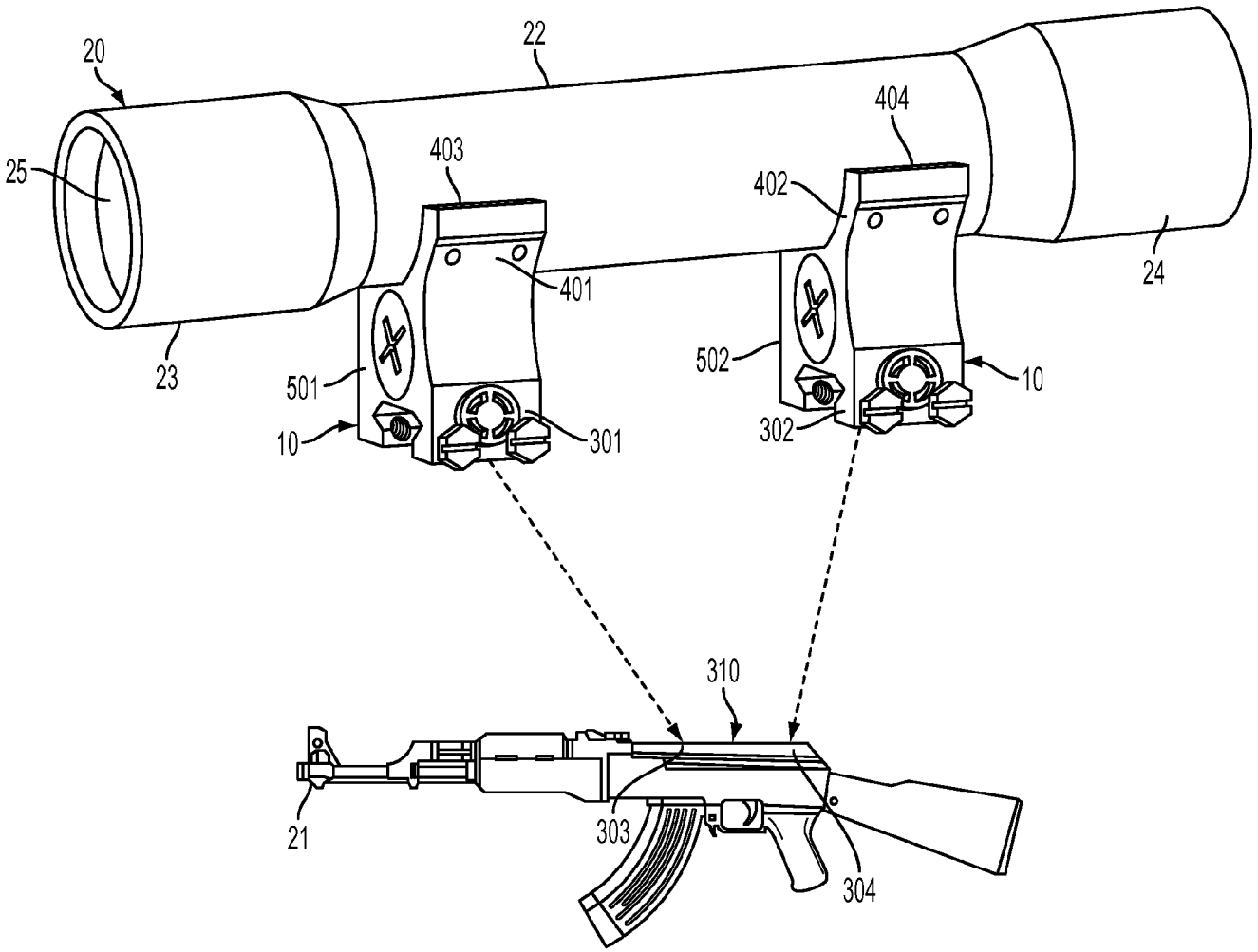
FIG. 1 is a perspective view of a sight mount in accordance with embodiments.
Figure 2:
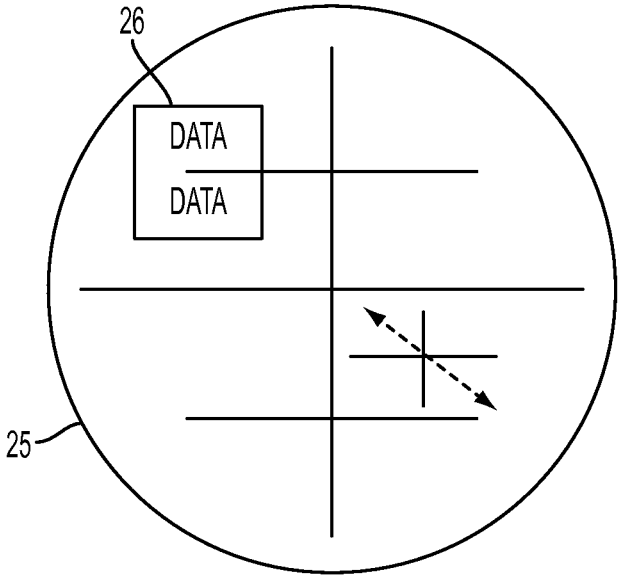
FIG. 2 is a view through the sight mount of FIG. 1.

As will be described below, a sight mount is provided to externally power electronics in a mounted sighting system or other similar device. Limited space is normally available in conventional internally powered sights that place substantial restrictions on battery size and quantity in the absence of radical envelope design changes. Meanwhile, power requirements for mounted sighting systems have increased due to electronic sight enhancements becoming integrated into the sighting systems. In the sight mount described below, however, increased power requirements are met and the restrictions on battery size and quantity are avoided. That is, the sight mount described herein can be provided as individual rings or a mount where the ring interface is part of an integral mount and a volume in the sight mount or mounting ring is used to locate the power source. This approach frees valuable space in the sight envelope and generally increases the battery storage capacity which, in turn, increases operational life and makes it possible to add more electronics in sighting systems. The sight mount fits within the general envelope of sight mounts and mounting rings, seals against moisture and other contaminants and is ruggedly capable of withstanding environmental requirements of gunfire shock while minimizing mass increase.

With reference to FIGS. 1-5, a sight mount 10 is provided for use with an electrically powered sight 20. The electrically powered sight 20 may be disposable for use with, for example, a sighting instrument or a shoulder mounted weapon such as a rifle 21. For the purposes of clarity and brevity, the following description will relate to the case where the electrically powered sight 20 is disposable for use with the rifle 21, although it is to be understood that this embodiment is merely exemplary. When attached to the exemplary rifle 21, the electrically powered sight 20 sits on a top surface of the rifle 21 and is disposed to be aligned with the long axis of the rifle 21 barrel. In this position, the electrically powered sight 20 can be employed by the user to aim the rifle 21 by looking through the electrically powered sight 20 toward a target.

The electrically powered sight 20 includes an elongate body 22 having a first end 23 and a second end 24 and a longitudinal axis that can be aligned with the longitudinal axis of the item to which the electrically powered sight 20 is attached (e.g., the rifle 21 as described above). Optical elements 25, such as lenses, are disposed in each of the first and second ends 23 and 24 to magnify a sighted target. The optical element 25 may include additional aiming tools, such as cross-hairs, that can be aligned over the target to aid in aiming. The electrically powered sight 20 is further capable of electrically powered functionality, such as generation of a heads-up display, target illumination and night vision, and thus may further include optical enhancement elements 26 (see FIG. 2) that require electrical power. The sight mount 10 is disposed to provide for such electrical power and thus mitigates or reduces the need for the electrically powered sight 20 to have a stored power supply itself.

Figure 3:
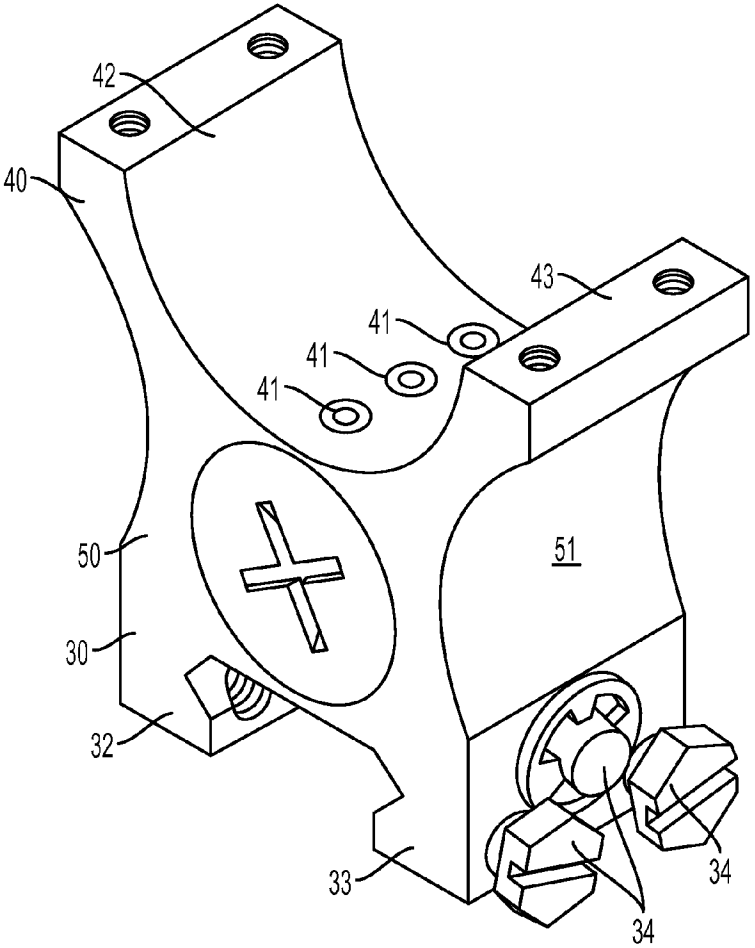
FIG. 3 is an enlarged perspective view of a portion of the sight mount of FIGS. 1 and 2.

As shown in FIG. 3, the sight mount 10 includes a lower portion 30, an upper portion 40 and a central portion 50. The lower portion 30 is connectably securable to a mounting surface or rail 31 of the rifle 21 (see FIG. 6 for rail 31 details) and has a first flange 32 and a second flange 33 as well as connection elements 34. The first and second flanges 32 and 33 extend downwardly from opposite sides of the central portion 50 and oppose one another on either side of the rail 31. The connection elements 34 extend through complementary portions of the first and second flanges 32 and 33 and permit secure connection of the lower portion 30 to the rail 31. The first and second flanges 32 and 33 may be substantially straight or may include opposite inwardly tapered faces that contact with the dovetail-shaped sides of the rail 31.

The upper portion 40 is supportive of the electrically powered sight 20 and includes electrodes 41 (see FIG. 3). The electrodes 41 are respectively connectable with sight circuitry whereby electricity may be provided to the electrically powered sight 20 from the sight mount 10 by way of the electrodes 41. The upper portion 40 may be semi- or fully-ring shaped and has first and second arced arms 42 and 43 extending from the opposite sides of the central portion 50. The first and second arced arms 42 and 43 oppose one another and are disposable to abut opposite sides of the electrically powered sight 20. The electrodes 41 may be disposed at a bottom-most section of the upper portion 40 from which the first and second arced arms 42 and 43 extend in opposite circumferential directions.

Figure 6:
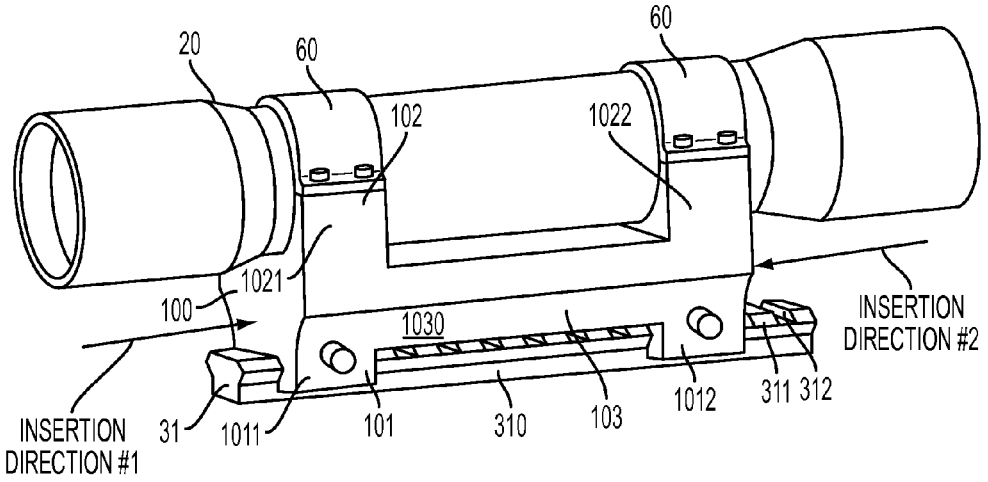
FIG. 6 is a perspective view of a sight mount in accordance with alternative embodiments.

With reference to FIG. 6, in the case of the upper portion 40 being fully-ring shaped, the upper portion 40 may include upper ring elements 60. As shown in FIG. 6, the upper ring elements 60 can be connected to the upper portion 40 at either side of the electrically powered sight 20 to further secure the electrically powered 20 in a vertical dimension.

In accordance with embodiments, the electrodes 41 may be substantially aligned with one another although it is to be understood that this configuration is merely exemplary and that other arrangements of the electrodes 41 are possible. Also, although three electrodes 41 are shown in FIG. 3, less or additional electrodes 41 may be employed for differing functionalities. In the aligned embodiment shown in FIG. 3, the outer-most electrodes 41 may be provided as source electrodes whereas the central electrode 41 may be provided as a ground electrode.

The central portion 50 is integrally interposed between the lower portion 30 and the upper portion 40. The central portion 50 includes a substantially rigid body 51 that is formed to define a cavity 52 therein. The central portion 50 further includes a power supply 53 and a securing element 54. The power supply 53 is disposed in the cavity 52 and is disposed to be electrically coupled to the electrodes 41 to thereby provide electricity or electric power to the electrically powered sight 20. The securing element 54 is engageable with the body 51 to secure the power supply 53 in the cavity 52 in a ruggedized manner.

In accordance with embodiments and, as shown in FIGS. 1 and 6, the rail 31 may include or be provided as an elongate mounting surface or rail 310. In this case, the sight mount 10 can be connectably secured to the elongate rail 310 at multiple axial locations for additional rigidity and aiming accuracy. That is, the lower portion 30 may include or be provided as first and second lower portions 301 and 302 (see FIG. 1). In this case, the first lower portion 301 is connectably securable to a first axial location 303 defined along the elongate rail 310 and the second lower portion 302 is connectably securable to a second axial location 304 defined along the elongate rail 310. Similarly, in order to provide for additional rigidity and aiming accuracy of the electrically powered sight 20, the upper portion 40 may include or be provided as first and second upper portions 401 and 402. Here, the first upper portion 401 is supportive of the electrically powered sight 20 at a first axial location 403 defined along the electrically powered sight 20 to correspond to the first axial location 303 and the second upper portion 402 is supportive of the electrically powered sight 20 at a second axial location 404 defined along the electrically powered sight 20 to correspond to the second axial location 304.

Where the lower portion 30 includes or is provided as the first and second lower portions 301 and 302 and the upper portion 40 includes or is provided as the first and second upper portions 401 and 402, the central portion 50 may include or be provided as first central portion 501 and a second central portion 502. The first central portion 501 is thus integrally interposed between the first lower portion 301 and the first upper portion 401 and the second central portion 502 is thus integrally interposed between the second lower portion 302 and the second upper portion 402. Each of the first and second central portions 501 and 502 may be configured as described above with the respective power supplies 53 being disposed in series or in parallel.

Figure 4:
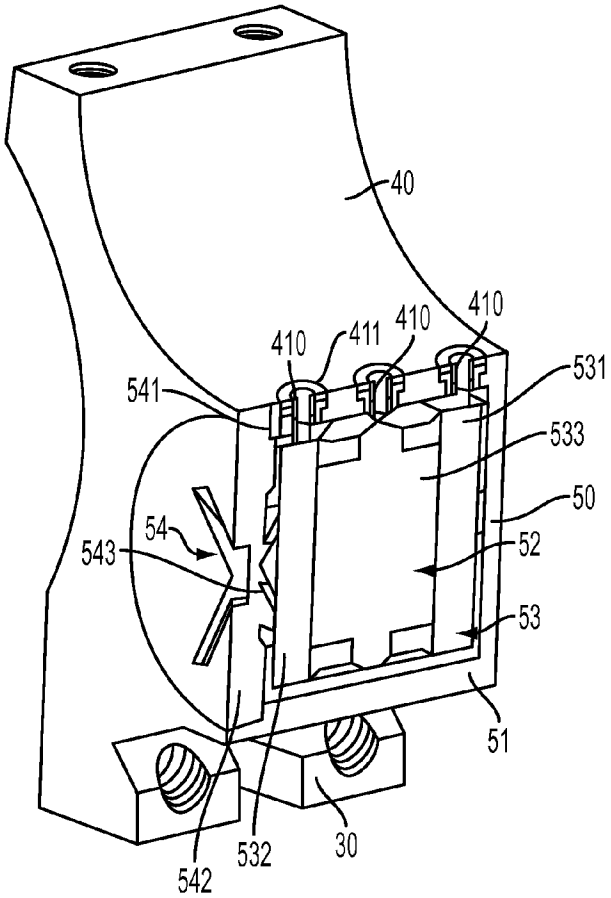
FIG. 4 is a cutaway perspective view of the portion of the sight mount of FIG. 3.
Figure 5:
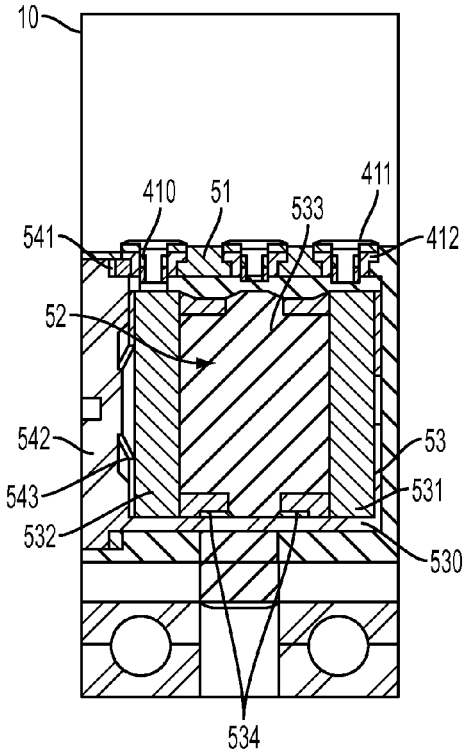
FIG. 5 is a cutaway side view of the portion of the sight mount of FIGS. 3 and 4.

As shown in FIGS. 4 and 5, the electrodes 41 may be provided as spring-loaded electrode elements 410 and may include sealing elements 411 and insulation material 412. In accordance with embodiments, each of the spring-loaded electrode elements 410 may include a plunger that is supported on the body 51 of the central portion 50 to be movable into and out of the cavity 52. Each of the sealing elements 411 may be provided as an O-ring seal that circumscribes a corresponding one of the plungers. As such, as the plungers move into and out of the cavity 52, an interior of the cavity 52 is sealed (i.e., hermetically sealed) from an exterior environment. Thus, ingress of moisture and/or foreign objects into the cavity 52 can be avoided or substantially hindered. The insulation material 412 may surround the spring-loaded electrode elements 410 and the sealing elements 411 and serves to electrically insulate the spring-loaded electrode elements 410 from surrounding conductive components.

The power supply 53 may include a cartridge housing 530, a first battery 531, a second battery 532, a conductive spacer 533 and non-conductive spacers 534. The cartridge housing 530 is formed of non-conductive material and is sized to fit tightly within the cavity 52 and has a closed end, sidewalls and an open end. The sidewalls extend from the closed end along a longitudinal length of the cavity and have openings defined therein through which the spring-loaded electrode elements 410 are extendible. The open end is defined at an end of the cartridge housing 530 opposite from the closed end and corresponds to an open end of the cavity 52. The cartridge housing 530 is thus formed to define an open-ended interior in which the first and second batteries 531 and 532 and the conductive and non-conductive spacers 533 and 534 are securable so that the entire power supply 53 can be inserted into or removed from the cavity 52 as a single unit.

In accordance with embodiments, the first battery 531 is disposable proximate to the closed end of the cartridge housing 530 and the second battery 532 is disposable proximate to the open end of the cartridge housing 530. The conductive spacer 533 may be interposed between the first and second batteries 531 and 532 and has protrusions extending from opposite ends thereof. The non-conductive spacers 534 may be interposed between each of the protrusions of the conductive spacer 533, each of the first and second batteries 531 and 532 and the interior surfaces of the cartridge housing 530.

The openings defined in the sidewalls of the cartridge housing 530 correspond to the first and second batteries 531 and 532 and to one of the protrusions of the conductive spacer 533. Thus, as the power supply 53 is installed within the cavity 52, the openings pass by the spring-loaded electrode elements 410 such that the first and second batteries 531 and 532 and the conductive spacer 533 come into sequential contact and non-contact with the spring-loaded electrode elements 410 until full insertion is achieved. That is, as the power supply 53 is installed within the cavity 52, the opening associated with the first battery 531 slides past the first and second ones of the spring-loaded electrode elements 410 such that the first and second ones of the spring-loaded electrode elements 410 sequentially extend into and then out of the opening. Once the full insertion position is reached, however, the third spring-loaded electrode element 410 extends into the opening to come into contact with the first battery 531.

A similar sequence occurs for the opening associated with the protrusion of the conductive spacer 533 until the full insertion position is reached at which point the second spring-loaded electrode element 410 extends into the opening to come into contact with the protrusion of the conductive spacer 533. Finally, the opening associated with the second battery 532 enters the cavity 52 and reaches its full insertion position immediately whereupon the first spring-loaded electrode element 410 extends into the opening to come into contact with the second battery 532.

Once the first and second batteries 531 and 532 and the conductive spacer 533 are contacted by the third, first and second spring-loaded electrode elements 410, respectively, the third and first spring-loaded electrode elements 410 form a conductive pathway for source voltage of the electrically powered sight 20 and the second spring-loaded electrode element 410 forms a conductive pathway for ground voltage. In this or any other case, the first and second batteries 531 and 532 may be disposed in series or in parallel configuration. Moreover, where the sight mount 10 includes multiple central portions, as in the first central portion 501 and the second central portion 502 and thus multiple cavities 52 and power supplies 53, the various combinations of the first and second batteries 531 and 532 in each may be disposed in series or in parallel (internally and/or externally) with one another.

The securing element 54 is engageable with the body 51 to secure the power supply 53 in the cavity 52 in a ruggedized manner and includes a sealing element 541, an end cap 542 and a pre-loaded, non-conductive impingement element 543. The sealing element 541 may be provided as an O-ring seal that is disposed at the body 51 of the central portion 50 proximate to the opening of the cavity 52. The end cap 542 is rotatable in a first direction to tighten the end cap 542 onto the sealing element 541 and the body 51 and in a second direction, which is opposite the first direction, to loosen the end cap 542 away from the sealing element 541 and the body 51. The pre-loadable impingement element 543 is interposable between the end cap 542 and the power supply 53 (i.e., the second battery 532) and may be elastically urged toward the power supply 53 by the end cap 542 with the end cap 542 in a tightened condition. That is, as the end cap 542 is tightened onto the body 51, the end cap 542 pushes against the pre-loadable impingement element 543, which, in turn, pushes against the second battery 532. Once the end cap 542 is fully tightened, the power supply 53 as a whole is thus secured by the pre-loadable impingement element 543 against jostling and other external applications of force.

With reference to FIG. 6, the rail 31 may be provided as the elongate rail 310 and includes multiple bosses 311 and grooves 312. The grooves 312 are defined axially between the bosses 311, which set the grooves 312 at discrete axial locations along the rifle 21. In accordance with embodiments, the rail 31 may have a dovetail cross-sectional shape that corresponds to complementary shapes of the first and second flanges 32 and 33 such that the sight mount 10 can be slid axially along the rail 31 while being prevented from moving upwardly and downwardly. In addition, a fastener or connection elements 34 can be securably driven through the first and second flanges 32 and 33 to thereby secure the first and second flanges 32 and 33 at one of the grooves 312 and thus one discrete axial position along the rail 31.

While the embodiments described above with reference to FIGS. 1-5 relate to the sight mount 10 being formed of at least one sight mount ring formations, as shown in FIG. 6, the sight mount 10 may be provided as an integral, elongate sight mount body 100. The integral, elongate sight mount body 100 includes a lower sight mount portion 101, an upper sight mount portion 102 and a central sight mount portion 103. The lower sight mount portion 101 includes first and second lower sight mount end portions 1011 and 1012 that are connectably securable to first and second axial locations defined along the elongate rail 310, respectively. The upper sight mount portion 102 includes first and second upper sight mount end portions 1021 and 1022 and is supportive of the electrically powered sight 20 at first and second axial locations defined along the electrically powered sight 20. The central sight mount portion 103 includes an elongate central sight mount portion 1030 that is integrally interposed at a first end thereof between the first lower sight mount end portion 1011 and the first upper sight mount end portion 1021 and at a second end thereof between the second lower sight mount end portion 1021 and the second upper sight mount end portion 1022.

In accordance with the embodiments of FIG. 6, the first and second ends of the central sight mount portion 103 may be formed to define cavities substantially as described above so that power supplies 53 can be respectively stored therein and secured with securing elements 54. However, while the installation direction for the embodiments of FIG. 1-5 may be the same for each sight mount 10, in the case of FIG. 6, the installation directions oppose one another for each end (see, e.g., the installation directional arrows of FIG. 6).

Figure 7:
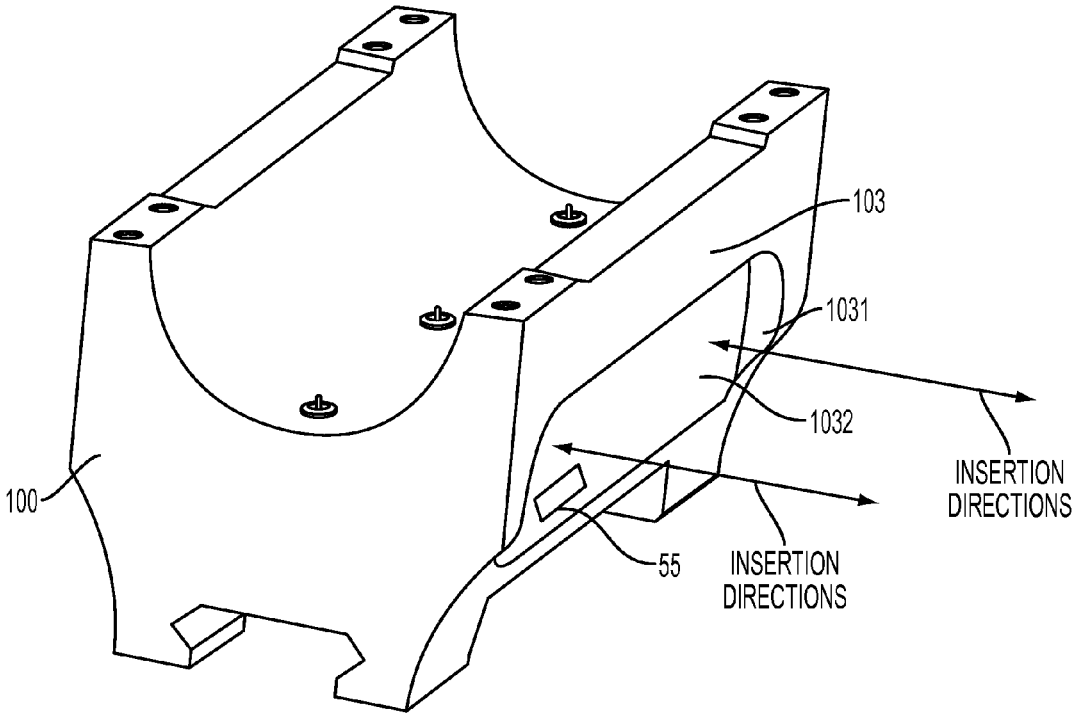
FIG. 7 is a perspective view of a sight mount in accordance with further alternative embodiments.

In accordance with alternative embodiments and, with reference to FIG. 7, the power supply 53 may be insertable into or withdrawn from the elongate sight mount body 100 (or the sight mount 10) in forward and reverse lateral directions. In this case, a side of the elongate sight mount body 100 may be formed to define an aperture 1031 through which the power supply 53 can be moved. In addition, the elongate sight mount body 100 may include an aperture cover 1032, which is disposable in the aperture 1031 to secure the power supply in the cavity 52 (not shown in FIG. 7). As above, in the alternative embodiments of FIG. 7, the power supply 53 may include multiple batteries disposed in series or in parallel with one another.

In accordance with still further embodiments and, with continued reference to FIG. 7, the power supply 53 of any and all embodiments described herein may include rechargeable batteries. In such cases, as shown in FIG. 7, a connection port 55 is provided by which electric current can be supplied to the rechargeable batteries for charging operations. The connection port 55 can be disposed on the aperture cover 1032, the end cap 542, the elongate sight mount body 100 or the sight mount 10. In any case, wiring may be provided to electrically couple the connection port 55 to the rechargeable batteries.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The described embodiments were chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A sight mount that is configured for use with an electrically powered sight, the sight mount comprising:

a lower portion connectably securable to a mounting surface;

an upper portion supportive of the electrically powered sight and comprising electrodes connectable with circuitry of the electrically powered sight; and a central portion integrally interposed between the lower and upper portions and comprising a body formed to define a cavity securably receptive of a power supply such that the power supply couples with the electrodes to power the electrically powered sight, wherein the power supply comprises batteries and a conductive spacer housed within a cartridge defining openings that pass by the electrodes during power supply insertion into the cavity such that the batteries and the conductive spacer come into sequential contact, non-contact and contact with the electrodes.

2. The sight mount according to claim 1, wherein the sight mount is configured for use with an electrically powered sight comprising optical enhancement elements.

3. The sight mount according to claim 1, wherein the lower portion is connectably securable to an elongate mounting surface of a shoulder mounted weapon.

4. The sight mount according to claim 3, wherein:

the lower portion comprises first and second lower portions connectably securable to first and second axial locations defined along the elongate mounting surface, respectively, the upper portion comprises first and second upper portions supportive of the electrically powered sight at first and second axial locations defined along the electrically powered sight, and the central portion comprises a first central portion integrally interposed between the first lower and the first upper portions and a second central portion integrally interposed between the second lower and the second upper portions.

5. The sight mount according to claim 4, wherein the first and second central portions each comprise a body formed to define a cavity securably receptive of a power supply such that the power supply couples with the electrodes to power the electrically powered sight.

6. The sight mount according to claim 5, wherein respective power supplies of the first and second central portions are disposed in series or parallel.

7. The sight mount according to claim 1, wherein the power supply is rechargeable.

8. The sight mount according to claim 1, wherein the electrodes comprise:

spring-loaded electrode elements; and sealing elements disposed about each of the electrode elements.

9. The sight mount according to claim 1, wherein the power supply comprises first and second serial or parallel batteries.

10. The sight mount according to claim 1, further comprising a securing element to secure the power supply in the cavity, the securing element comprising:

a sealing element; and an end cap, which is rotatable in a first direction to tighten the end cap onto the sealing element and the body and in a second direction to loosen the end cap away from the sealing element and the body; and a pre-loadable impingement element elastically urged toward the power supply by the end cap with the end cap in a tightened condition.

11. A sight mount that is configured for use with an electrically powered sight and an elongate mounting surface of a shoulder mounted weapon, the sight mount comprising:

a lower portion connectably securable to the mounting surface;

an upper portion supportive of the electrically powered sight a Id comprising first, second and third electrodes connectable with circuitry of the electrically powered sight; and a central portion integrally interposed between the lower and upper portions and comprising a body formed to define a cavity securably receptive of first and second batteries and a conductive spacer such that the first and second batteries and the conductive spacer couple with the first, second and third electrodes to power the electrically powered sight, wherein, during insertion of the first and second batteries and the conductive spacer into the cavity, the first battery comes into sequential contact, non-contact, contact, non-contact and contact with the first, second and third electrodes, the conductive spacer comes into sequential contact, non-contact and contact with the first and second electrodes and the second battery comes into contact with the first electrode.

12. The sight mount according to claim 11, wherein the first second and third electrodes comprise:

spring-loaded electrode elements; and sealing elements disposed about each of the electrode elements.

13. The sight mount according to claim 11, further comprising a securing element to secure the first and second batteries in the cavity, the securing element comprising:

a sealing element;

an end cap, which is rotatable in a first direction to tighten the end cap onto the sealing element and the body and in a second direction to loosen the end cap away from the sealing element and the body; and a pre-loadable impingement element elastically urged toward the first and second batteries by the end cap with the end cap in a tightened condition.

14. The sight mount according to claim 11, wherein the first and second batteries are rechargeable.

* * * * *